US012268342B2

(12) United States Patent
Slothower et al.

(10) Patent No.: US 12,268,342 B2
(45) **Date of Patent: *Apr. 8, 2025**

(54) TOILET SEAT

(71) Applicant: Kohler Co., Kohler, WI (US)

(72) Inventors: Erich Slothower, Mill Valley, CA (US); Mary J. Reid, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/225,972

(22) Filed: Jul. 25, 2023

(65) Prior Publication Data

US 2023/0363596 A1 Nov. 16, 2023

Related U.S. Application Data

(63) Continuation of application No. 17/869,382, filed on Jul. 20, 2022, now Pat. No. 11,744,415, which is a continuation of application No. 17/222,665, filed on Apr. 5, 2021, now Pat. No. 11,426,036.

(60) Provisional application No. 63/011,896, filed on Apr. 17, 2020.

(51) Int. Cl.
*A47K 13/02* (2006.01)
*A47K 13/12* (2006.01)

(52) U.S. Cl.
CPC ..... *A47K 13/02* (2013.01); *A47K 13/12* (2013.01)

(58) Field of Classification Search
CPC ..... A47K 13/00–13/06; A47K 13/12
See application file for complete search history.

(56) References Cited

U.S. PATENT DOCUMENTS

| | | | |
|---|---|---|---|
| 4,398,307 | A | 8/1983 | Ginsburg et al. |
| 5,666,672 | A | 9/1997 | Birsel et al. |
| 6,370,704 | B1 | 4/2002 | White, Jr. |
| 6,643,851 | B1 | 11/2003 | Janes |
| 7,389,549 | B2 | 6/2008 | Vierkant, III |
| 8,205,274 | B2 | 6/2012 | Lin et al. |
| 8,312,571 | B2 | 11/2012 | Vierkant, III et al. |
| 8,850,629 | B2 | 10/2014 | Vierkant, III et al. |

(Continued)

FOREIGN PATENT DOCUMENTS

| | | | |
|---|---|---|---|
| CN | 101472513 | A | 7/2009 |
| CN | 201510233 | U | 6/2010 |

(Continued)

OTHER PUBLICATIONS

Beall, Robert A. "Installing A Snap-On Toilet Seat." PRWeb, Cision PRweb , Aug. 22, 2012, www.prweb.com/releases/snap-on-toilet-seat/mr-rooter-plumbing/prweb9825134.htm. (pp. 1=3).

(Continued)

*Primary Examiner* — Christine J Skubinna
(74) *Attorney, Agent, or Firm* — Lempia Summerfield Katz LLC

(57) ABSTRACT

Disclosed is a flexible toilet seat including a top surface; a bottom surface; an inner edge, at which the top and bottom surfaces meet; an inner region, configured to elastically and vertically deform inward relative to the outer edge in response to an applied load; and an outer region supported by an upper surface of a toilet and configured to support the inner region.

21 Claims, 15 Drawing Sheets

(56) References Cited

U.S. PATENT DOCUMENTS

| | | | | |
|---|---|---|---|---|
| 9,107,548 | B2 * | 8/2015 | Hand | F16B 31/021 |
| 9,312,571 | B2 | 4/2016 | Wang et al. | |
| 9,549,647 | B2 | 1/2017 | Leibfried | |
| 9,943,198 | B2 * | 4/2018 | Yang | A47K 13/26 |
| 11,253,117 | B2 | 2/2022 | De Pena | |
| 2003/0024036 | A1 | 2/2003 | Toldo et al. | |
| 2007/0294810 | A1 | 12/2007 | Vierkant et al. | |
| 2015/0082527 | A1 | 3/2015 | Grudzinski | |
| 2015/0216379 | A1 * | 8/2015 | Chen | A47K 13/12 4/240 |
| 2016/0015226 | A1 * | 1/2016 | Chen | A47K 13/06 4/235 |
| 2017/0150854 | A1 | 6/2017 | Tsujita et al. | |
| 2020/0375416 | A1 | 12/2020 | Hand et al. | |
| 2021/0153703 | A1 * | 5/2021 | Stammel | A47K 13/12 |

FOREIGN PATENT DOCUMENTS

| | | | |
|---|---|---|---|
| CN | 202960356 | U | 6/2013 |
| CN | 203564171 | U | 4/2014 |
| CN | 103945748 | A | 7/2014 |
| CN | 203979109 | U | 12/2014 |
| CN | 204260651 | U | 4/2015 |
| CN | 209712735 | U | 12/2019 |
| DE | 19851642 | A1 | 5/2000 |
| GB | 983787 | A | 2/1965 |
| GB | 1304306 | A | 1/1973 |
| JP | 2006345286 | A | 12/2006 |
| JP | 2008073381 | A | 4/2008 |
| JP | 2015002905 | A | 1/2015 |
| KR | 100878475 | B1 | 1/2009 |
| KR | 20140030461 | A | 3/2014 |
| KR | 20150097979 | A | 8/2015 |

OTHER PUBLICATIONS

Chinese Office Action from Chinese Patent No. 202110417276.X, dated Apr. 20, 2022, 12 pages (including English Summary).

"Toilet Seat Elongated Bath Royale Br606-00 White Premium Elongated Toilet Seat Slow Close, Replacement Toilet Seat Fits All Toilet Brands Including Kohler, Toto and American Standard." Bath Royale. Amazon. https://www.amazon.com/Bath-Royale-Elongated-Slow-Close-Quick-Release/dp/B00NAIO6CM (pp. 1-9).

* cited by examiner

TOILET SEAT

CROSS-REFERENCE TO RELATED APPLICATIONS

This application is a continuation under 35 U.S.C. § 120 and 37 C.F.R. § 1.53(b) of U.S. patent application Ser. No. 17/869,382 filed Jul. 20, 2022, which is a continuation under 35 U.S.C. § 120 and 37 C.F.R. § 1.53(b) of U.S. patent application Ser. No. 17/222,665 filed Apr. 5, 2021, which claims priority benefit of Provisional Application No. 63/011,896 filed Apr. 17, 2020, which is hereby incorporated by reference in its entirety.

BACKGROUND

The present application relates generally to the field of seats for toilets. More specifically, the present disclosure relates to user-specifically adapting a position and/or flex of a seat region.

Toilet seats are often uncomfortable to users (in particular, larger users), prone to deterioration with time and repeated use, difficult to thoroughly clean and maintain, and/or pains-taking to install. Many toilet seats designed for repeated, high-volume use include features to enhance longevity and/or cleanability but do not provide comfort to a user. Other toilet seat models intended to enhance user comfort are often complex in design and require multiple tools to install and/or adjust, and/or comprise materials that do not remain robust over time. In addition, many such designs include numerous features that are hidden or minimally accessible, which render the seat and comprising features difficult and, in some cases, impossible to clean. Finally, many toilet seat designs include one or more joints and/or features that, when loaded (e.g., when a user sits on the seat), are prone to excessive strain and subsequent mechanical failure from lateral and/or rotational movements (e.g., when a user repositions or shifts while on the seat).

Accordingly, it would be advantageous to provide a toilet seat that is simple to install, easy to clean, readily adaptable to improve comfort for individual users of varying sizes, and robust during use over the life of the seat.

SUMMARY

At least one embodiment of the application relates to a toilet seat system or toilet seat assembly that includes a seat and a lid, each of which are rotatably coupled via a hinge assembly. The seat is configured to have an outer edge that is supported by an upper surface of a toilet. An inner edge of the toilet seat curves away from the outer edge of the toilet. The configuration of the seat enables vertical displacement (e.g., "flex") of the inner edge when a load is applied to the seat (e.g., when a user sits on the seat) and the toilet supports the outer edge. Furthermore, the seat may flex responsive to a magnitude and/or location of the applied load. The flex response of the seat relieves pressure on an ischial tuberosity (i.e., "sit bones") of the user, enhancing comfort.

The flexible seat can include a hollow channel located at an end of the seat. The hinge assembly includes one or more quick-connect (e.g., snap-on) hinges, which are configured to engage with the hollow channel within the seat and with one or more arms extending from an end of the lid. The hinge assembly enables rotation and repositioning of each of the seat and the lid. The one or more quick-connect hinges are configured to be individually coupled to a toilet via a hinge tower, an anchor, and a fastener. In various embodiments, each of the hinge towers, the anchors, and the fasters, are configured to fit within a quick-connect hinge upon coupling.

In various embodiments, the seat includes a bumper along a bottom surface of the seat, which is configured to be in contact with an upper surface of the toilet, for example along an entire circumference of the bumper. The bumper may provide cushion to a user. The bumper may also aid in distributing the applied load (e.g., weight of the user) along the seat. In some embodiments, the bumper may partially adhere or grip the upper surface of the toilet to prevent lateral or side-to-side movement of the seat. In some embodiments, the bumper may be a separate, contiguous component coupled to a bottom surface of the seat. In other embodiments, the bumper may be continuous with the seat. In various embodiments, the bumper may be a rubber or other viscoelastic polymer or composite.

In various embodiments, the seat includes one or more dampers disposed within the hollow channel to facilitate controlled rotation of the seat and/or lid. For example, the dampers can provide resistance (e.g., friction) for slow closure of the seat and/or lid to prevent the seat/lid from slamming onto the toilet rim. In various embodiments, the hollow channel may also include a slot configured to engage with a locking tab. The locking tab may prevent disadvantageous movement or displacement of the dampers within the hollow channel.

In various embodiments, the toilet system includes a bowl having an upper surface, a first end, a second end, and a hole on the upper surface near the first end and a flexible toilet seat. The flexible toilet seat having an outer region supported by the upper surface of the bowl and an inner region configured to elastically and vertically deform inward relative to the outer region in response to an applied load. The flexible toilet seat may include a hinge, a hinge tower, and a flexible anchor. The hinge includes a first end and a second end, the first end rotatably attached to the flexible toilet seat and the second end forming an opening defined by an outer edge leading to a bore containing coupling features. The hinge tower includes a first end and a second end, the first end having coupling features configured to facilitate coupling with the second end of the hinge, and the first end of the hinge tower being configured to couple within the opening of the hinge. The flexible anchor includes a first end and a second end, the first end of the anchor configured to connect with the second end of the hinge tower and the flexible anchor being configured to fit within the hole on the upper surface of the bowl. At least one of the hinge tower and flexible anchor are made of substantially flexible material to facilitate flexible coupling of the flexible toilet seat with upper surface of the toilet. A bottom surface of the flexible toilet seat or a bumper is in contact with the upper surface of the bowl along a circumference of the bowl.

In various embodiments, each of the one or more quick-connect hinges includes one or more protruding features (e.g., tabs, ridges, knobs), which are configured to engage with one or more recessed features within a hinge tower. In various embodiments, each of the one or more quick-connect hinges is configured to flex within a region near where the quick-connect hinge engages with the hinge tower. During installation and operation, the quick-connect hinges may deform under a compressive load such that it causes disengagement from the hinge towers. The flexible quick-connect hinge configuration enables simple removal of the toilet seat system or assembly from a coupled toilet (via disengagement of the hinge towers from the quick-connect hinges).

In some embodiments, the seat may include one or more woven materials to facilitate deformation under an applied load. In various embodiments, the seat may include one or more heating coils to facilitate controllable heating of the seat and provide additional comfort to a user. In various embodiments, the one or more heating coils may be included within a composite and/or woven material within the seat. In some embodiments, the one or more heating coils may receive power via a power supply routed through the hinge assembly.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

A clear conception of the advantages and features constituting the present disclosure, and of the construction and operation of typical mechanisms provided with the present disclosure, will become more readily apparent by referring to the exemplary, and therefore non-limiting, embodiments illustrated in the drawings accompanying and forming a part of this specification, wherein like reference numerals designate the same elements in the several views, and in which.

Figure 1:
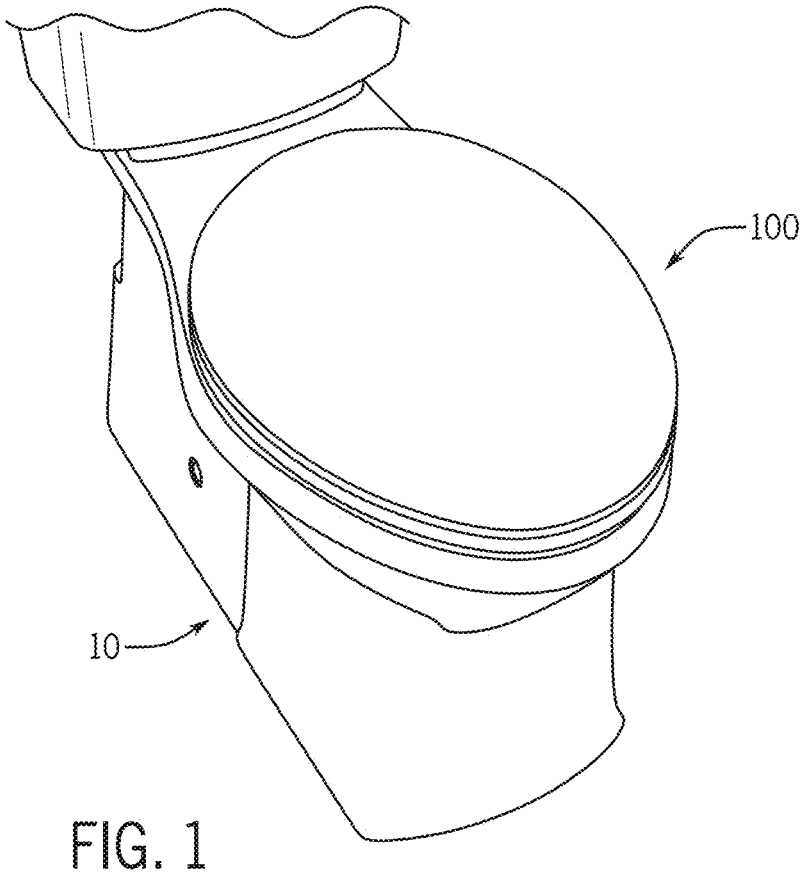
FIG. 1 is a perspective view of a toilet seat system coupled to a toilet, according to an exemplary embodiment of this application.

The foregoing and other features of the present disclosure will become apparent from the following description and appended claims, taken in conjunction with the accompanying drawings. Understanding that these drawings depict only several embodiments in accordance with the disclosure and are therefore, not to be considered limiting of its scope, the disclosure will be described with additional specificity and detail through use of the accompanying drawings.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Figure 2:
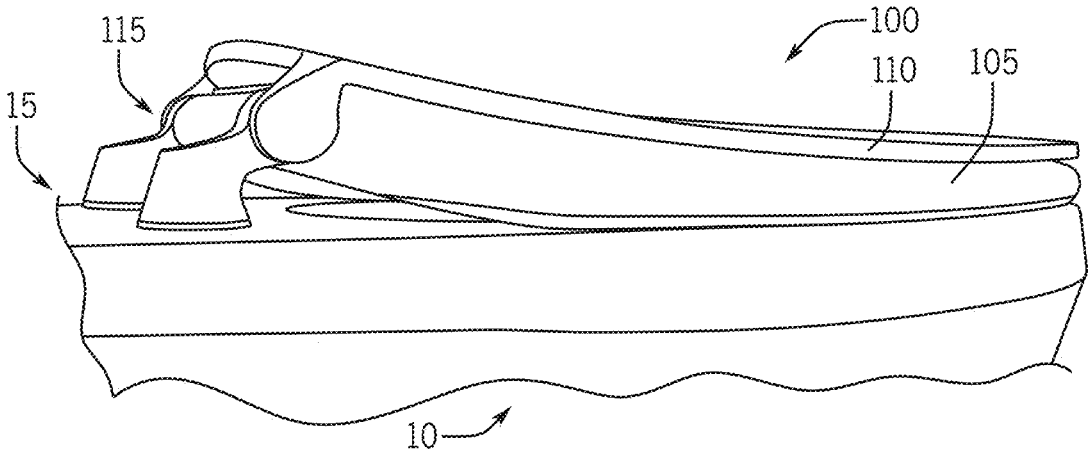
FIG. 2 is a side view of the toilet seat system and toilet of FIG. 1, according to an exemplary embodiment.

FIG. 1 illustrates an exemplary embodiment of a toilet seat system 100 operatively coupled to a toilet 10. In various embodiments, toilet 10 may be a one-piece toilet (i.e., tank and base/pedestal are integrally formed) or a two-piece toilet (e.g., tank is separately formed from and connected to a base/pedestal), as well as being either a wall-hung toilet or a floor mount toilet (as shown). In various embodiments, toilet 10 may be siphonic, gravity-fed, pressure-assisted, dual flush, double cyclone, waterless, or any other toilet type known in the art. FIG. 2 shows a side view of the toilet seat system 100 coupled to the toilet 10 at a location 15. The toilet seat system 100 includes a seat 105 and a lid 110, which are rotatably engaged and coupled to the toilet 10 via a hinge assembly 115 at a location 15, which is shown rearward of the bowl opening.

Figure 4:
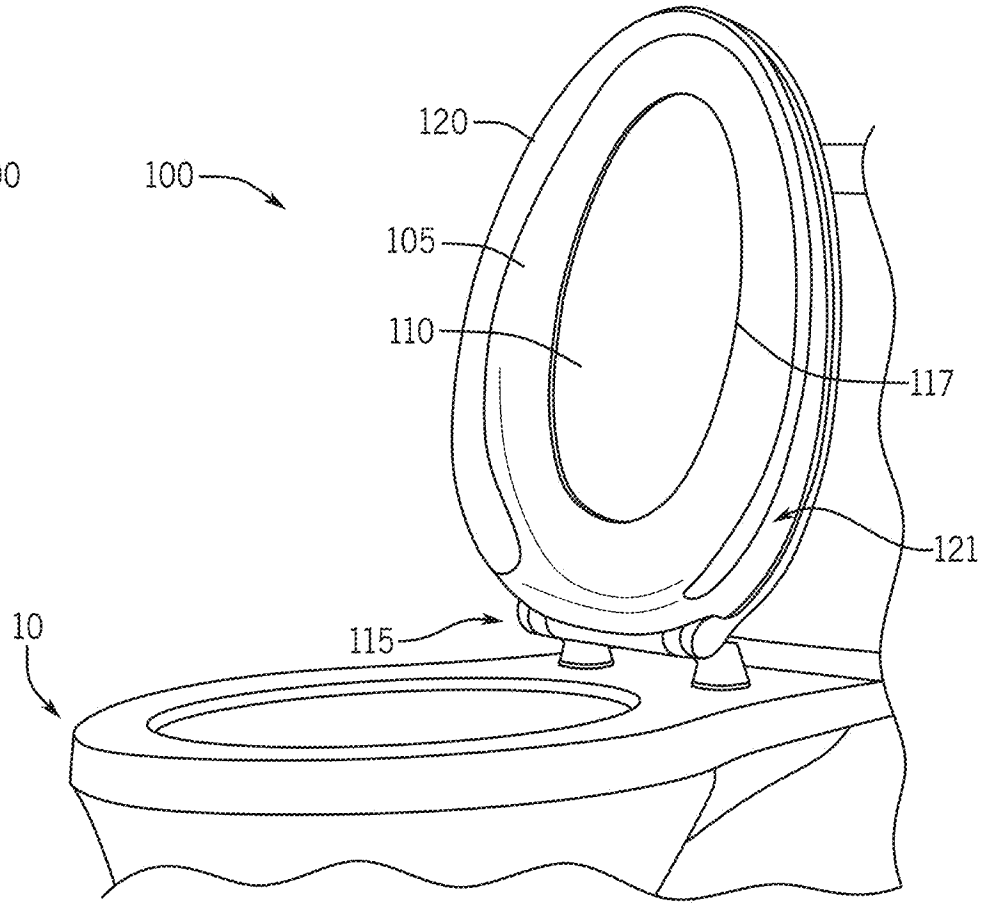
FIG. 4 is a side perspective view of the toilet seat system and toilet of FIG. 1 in a lifted position, according to an exemplary embodiment.
Figure 3:
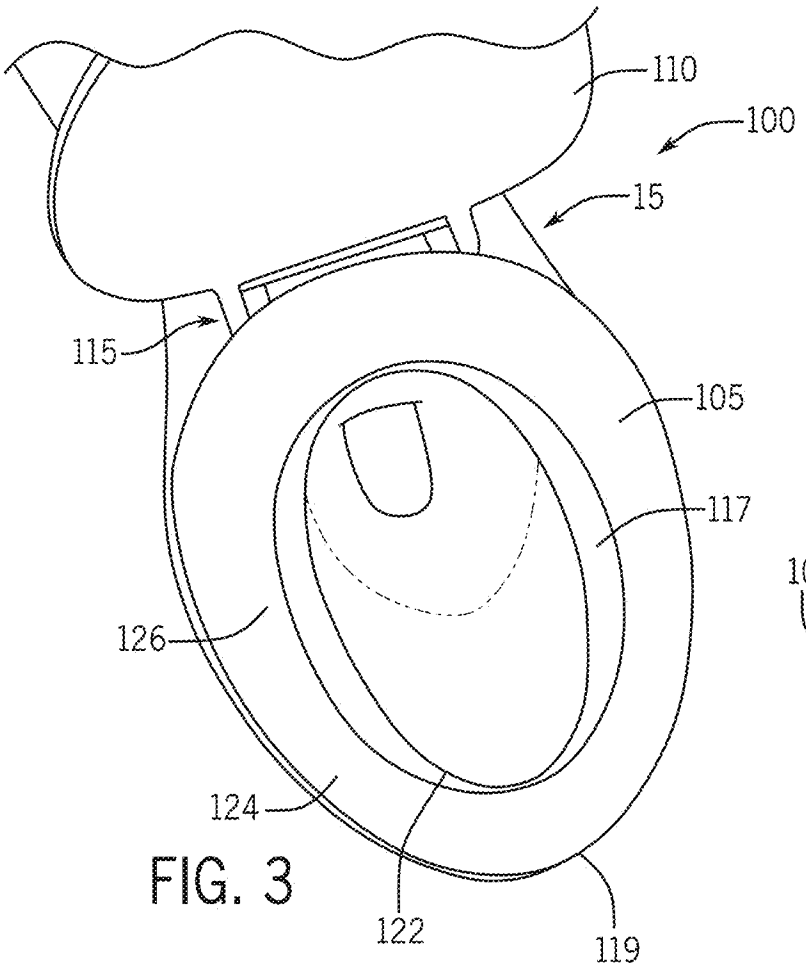
FIG. 3 is a top view of the toilet seat system coupled and toilet of FIG. 1, showing a lifted lid, according to an exemplary embodiment.

FIGS. 3 and 4 show the toilet seat system 100 in various lifted configurations, according to exemplary embodiments. FIG. 3 shows the toilet seat system 100 in a configuration wherein the lid 110 is rotated upward relative to the seat 105 about the hinge assembly 115. FIG. 4 shows the toilet seat system 100 in a fully lifted configuration wherein both of the lid 110 and the seat 105 are rotated upward about the hinge assembly 115. An inner region 117 of the seat 105 is configured to deform (e.g., elastically) in response to an applied load (e.g., when a user sits on seat 105). Deformation (e.g., "flex") of the region 117 facilitates improved comfort experienced by a user by relieving pressure applied to their ischial tuberosity. By deforming in response to a user load, the region 117 enables accommodation of a spectrum of users, including varying weights and/or dimensions thereof. In various embodiments, deformation of the region 117 may be facilitated by varying a thickness of the seat 105. In various embodiments, the region 117 may consist of a substantially flexible material that is prone to deform under an applied load. In some embodiments, the region 117 may be a separate component that is coupled to the seat 105 to form a contiguous region. In various embodiments, the region 117 may comprise one or more flexible materials that may be the same or different from one or more materials within the seat 105. In yet other embodiments, the region 117 may be formed by varying a cross-sectional shape of the seat 105. In various embodiments, an amount deformation of the region 117 is based on one or more materials within the region 117, a thickness of the region 117, a bending profile of the region 117 (e.g., bending of region 117 inward relative to an outer edge of the seat 105), a cross section of the region 117 and/or seat 105, or a combination thereof. In various embodiments, the amount of deformation of the region 117 is facilitated by a molded component comprising woven fibers. In some embodiments, the amount of deformation of the region 117 is based on a property such as a density, pattern, amount, or type of woven fiber included within the region 117. In various embodiments, a threshold amount of deformation of region 117 may be based on at least one of user height, weight, and gender. The amount or magnitude of the deformation of region 117 may vary according to any of these factors. The magnitude of the deformation may be up to a predetermined amount. Example predetermined amounts for the magnitude of the deformation of region 117 may include 1 centimeter, 2 centimeters, 3 centimeters, ½ inch, 1 inch or another values.

As shown in FIG. 4, the seat 105 includes a bumper 120 located on a bottom surface of a base 121 of the seat 105. The bumper 120 is positioned such that it is in contact with and grips an upper surface of the bowl of the toilet 10 (i.e., has a sufficient coefficient of friction to prevent sliding of the toilet seat system 100 relative to the toilet 10 when a user sits on the seat 105) when the toilet seat system 100 is in a lowered position (i.e., when the seat 105 is not rotated about hinge assembly 115) along a circumference of the upper surface of the bowl of the toilet 10 or a substantial portion thereof. The bumper 120 is configured to deform in response to applied loads (e.g., when a user sits on and/or shifts while using seat 105). The bumper 120 may prevent sideways (i.e., lateral) motion of the toilet seat system 100 by gripping the toilet 10 and deformation of the bumper 120 can adapt to potentially uneven upper surfaces 127 of the toilet 10. In various embodiments, the bumper 120 may deform downward when a user shifts their weight sideways relative to the toilet seat system 100. In various embodiments, an amount of downward deformation of the bumper 120 may be less than or equal to a predetermined value. Example values include 1 centimeter, 0.5 centimeters, 0.25 centimeters, 0.5 inches, 0.25 inches, 0.125 inches or 0.0625 inches. In other embodiments, the amount of downward deformation of the bumper may be greater than or equal to the predetermined value such as 0.125 inches. In various embodiments, the amount and/or a rate of deformation of the bumper 120 may be predetermined based on user comfort. Furthermore, deformation of the bumper 120 may provide additional comfort to a user by relieving potential pressure experienced by a user while sitting and/or shifting on the seat 105. In various embodiments, the bumper 120 is configured to increase comfort to a user when the user shifts their weight toward an edge of the seat 105. The bumper 120 may also prevent excessive stress on the hinge assembly 115 components by preventing and/or mitigating unnecessary and/or disadvantageous movement of seat 105. For example, disadvantageous movement of the seat may include, but is not limited to, lateral movement or rotation relative to the hinge assembly 115, impact against an upper surface of the toilet 10, etc. Disadvantageous movement may be caused by a user sitting suddenly, the user shifting while seated on the seat 105, the toilet seat system 100 falling from a lifted position, etc. In various embodiments, the bumper 120 may be located solely along an outer region of a bottom surface of the seat 105 (e.g., the base 121 of the seat 105). In various other embodiments, bumper 120 may be located along an entire bottom surface of the seat 105 and/or a portion thereof. In some embodiments, the bumper 120 may be a single, continuous bumper. In some embodiments, the bumper 120 may include one or more non-contiguous sections.

Figure 5:
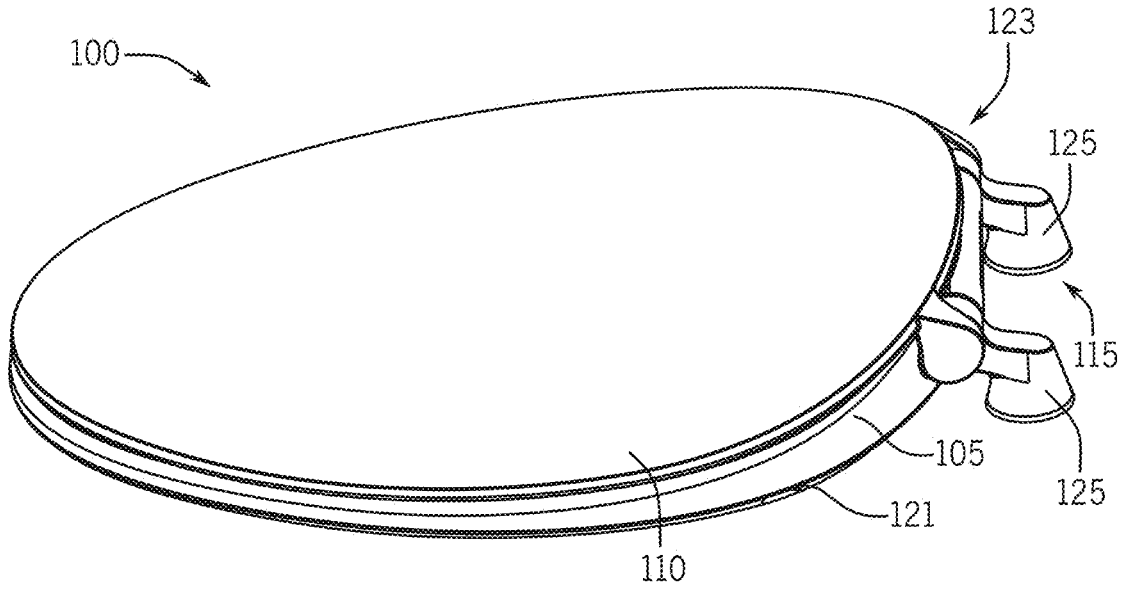
FIG. 5 is a perspective view of the toilet seat system of FIG. 1, according to an exemplary embodiment.
Figure 6:
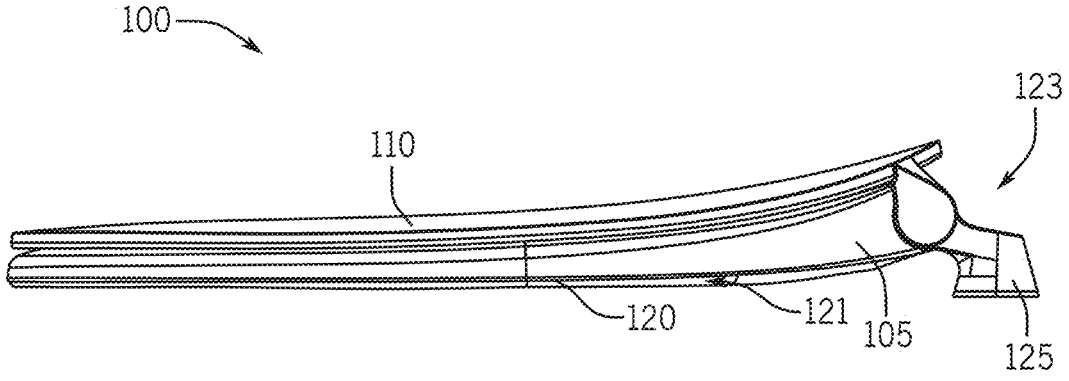
FIG. 6 is a side view of the toilet seat system of FIG. 1, according to an exemplary embodiment.

In some embodiments, the seat 105 may include one or more woven materials to facilitate and control deformation under an applied load. In various embodiments, the seat 105 may include one or more heating coils to facilitate controllable heating of the seat 105 and provide additional comfort to a user. In various embodiments, the one or more heating coils may be included within a composite and/or woven material within the seat 105. In some embodiments, heating elements can be woven into a composite material within the seat. In some embodiments, the one or more heating coils may receive power via a power supply routed through the hinge assembly 115. In various embodiments the power supply may include a power cord routed through the hinge assembly. A clip or fastener may secure the power cord to the hinge assembly. In some embodiments the power code may supply AC power to the at least one heating coil from a wall outlet power source. In other embodiments the power cord may supply power to the at least one heating coil from at least one battery. In various embodiments the battery is disposed in the toilet seat system 100 or toilet 10. FIGS. 5-9 show alternate views of the toilet seat system 100, according to various exemplary embodiments. FIG. 5 shows a side perspective view of toilet seat system 100, again illustrating relative configurations of the seat 105 and the lid 110, which rotate via the hinge assembly 115 located at a distal end 123 (e.g., a rear end) of the seat. The lid 110 and the seat 105 are also rotatably coupled to the hinges 125, which may be anchored or otherwise coupled to the toilet 10. FIG. 6 shows a side view of the toilet seat system 100, showing placement of the bumper 120 along a bottom surface of the seat 105.

Figure 8:
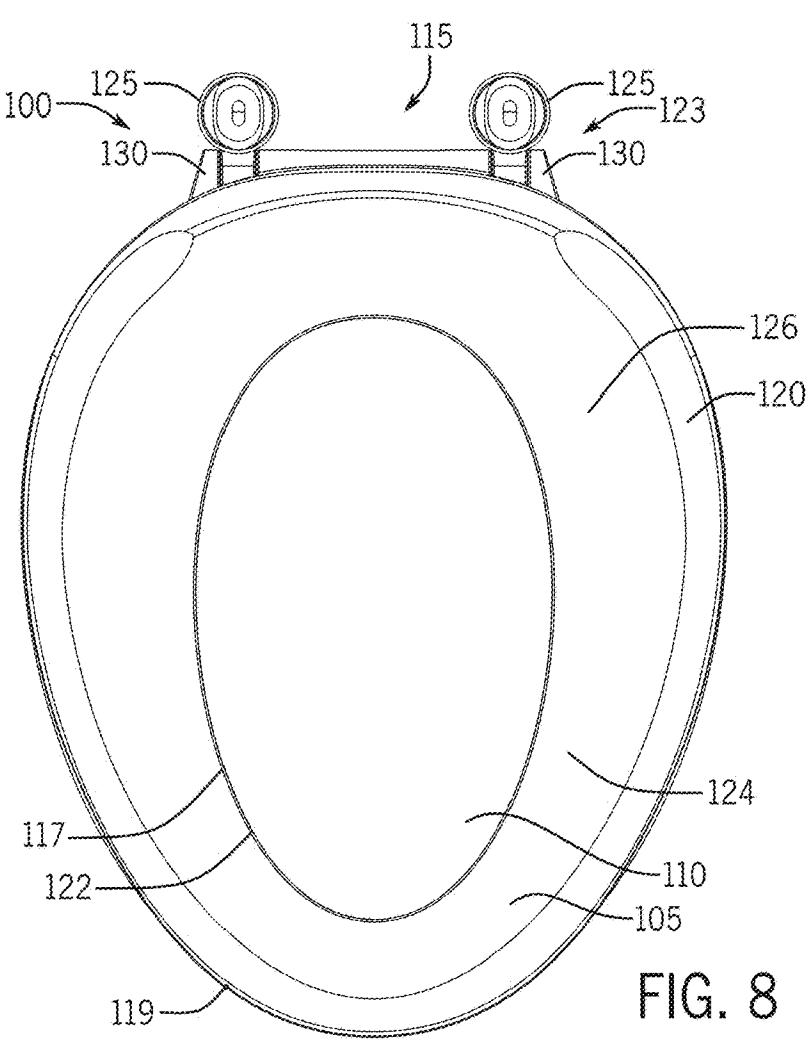
FIG. 8 is a bottom view of the toilet seat system of FIG. 1, according to an exemplary embodiment.
Figure 7:
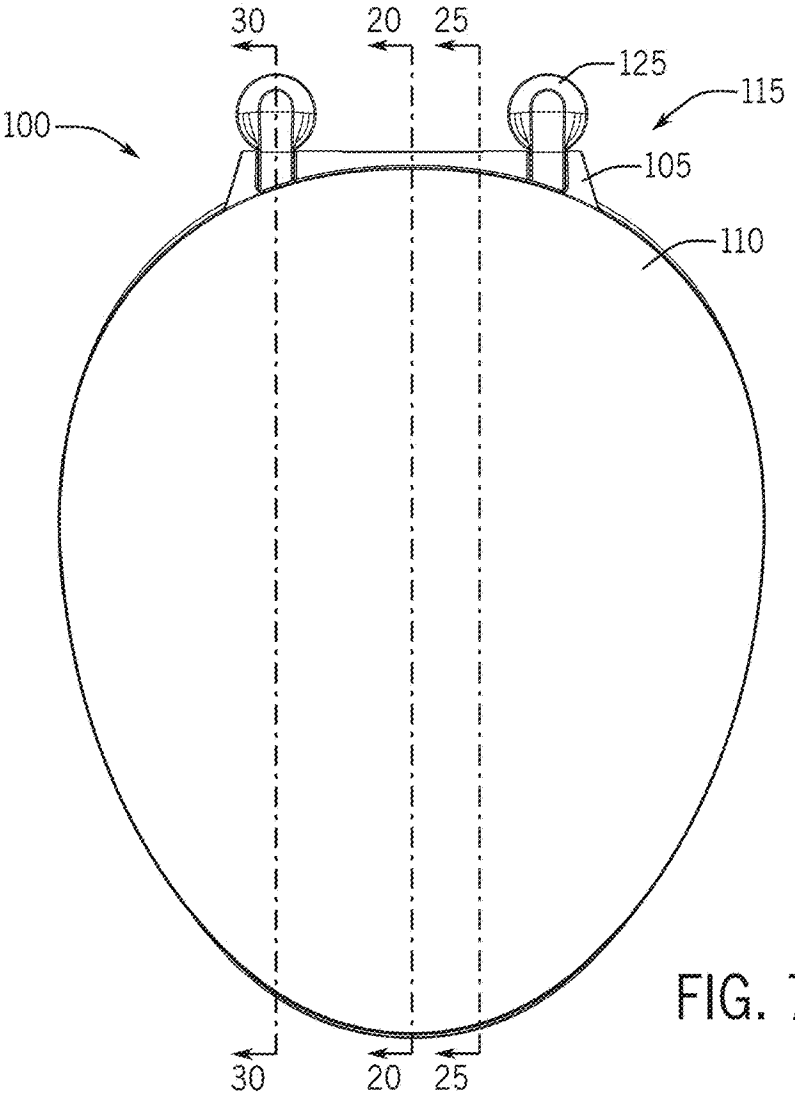
FIG. 7 is a top view of the toilet seat system of FIG. 1, according to an exemplary embodiment.

FIGS. 7 and 8 show top and bottom views, respectively of the toilet seat system 100, according to various exemplary embodiments. FIG. 7 illustrates relative configurations of the seat 105, the lid 110, and the hinges 125 within the toilet seat system 100. As shown in FIG. 8, the seat 105 may include the inner region 117 and the bumper 120, which may enable the seat 105 to enhance user comfort by flexing in response to a user-specific load.

Figure 9:
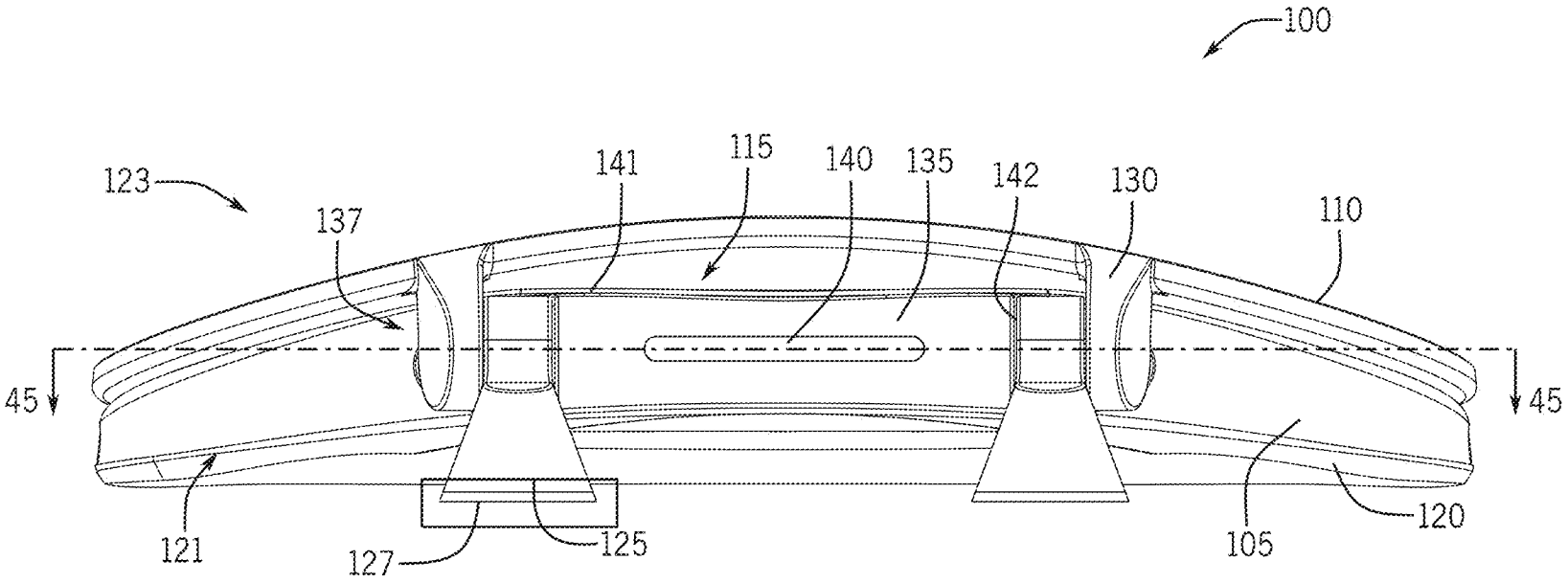
FIG. 9 is an end view of the toilet seat system of FIG. 1, according to an exemplary embodiment.

FIG. 9 shows a view of the toilet seat system 100 near the hinge assembly 115 at the distal end 123. As shown, the hinge assembly 115 includes a hollow channel 135 located at the distal end 123 of seat 105. The hollow channel 135 couples to the seat 105 and is configured to receive and operatively couple (e.g., engage) with the hinges 125 at the ends 141 and 142. The hinges 125 are further configured to operatively couple with one or more protruding arms 130 that extend from the distal end 123 of lid 110. Engagement of the hinges 125 with the hollow channel 135 and the arms 130 enable rotation of the lid 110 and the seat 105. As shown, seat 105 may also include one or more recesses 137, which facilitate unencumbered rotation of the lid 110 relative to the seat 105. Additionally, the hollow channel 135 may include a slot 140, which may be configured to receive a locking component (e.g., locking tab 170, which is discussed below) to prevent disadvantageous movement and/or disengagement of the hinge assembly 115 components.

Figure 10:
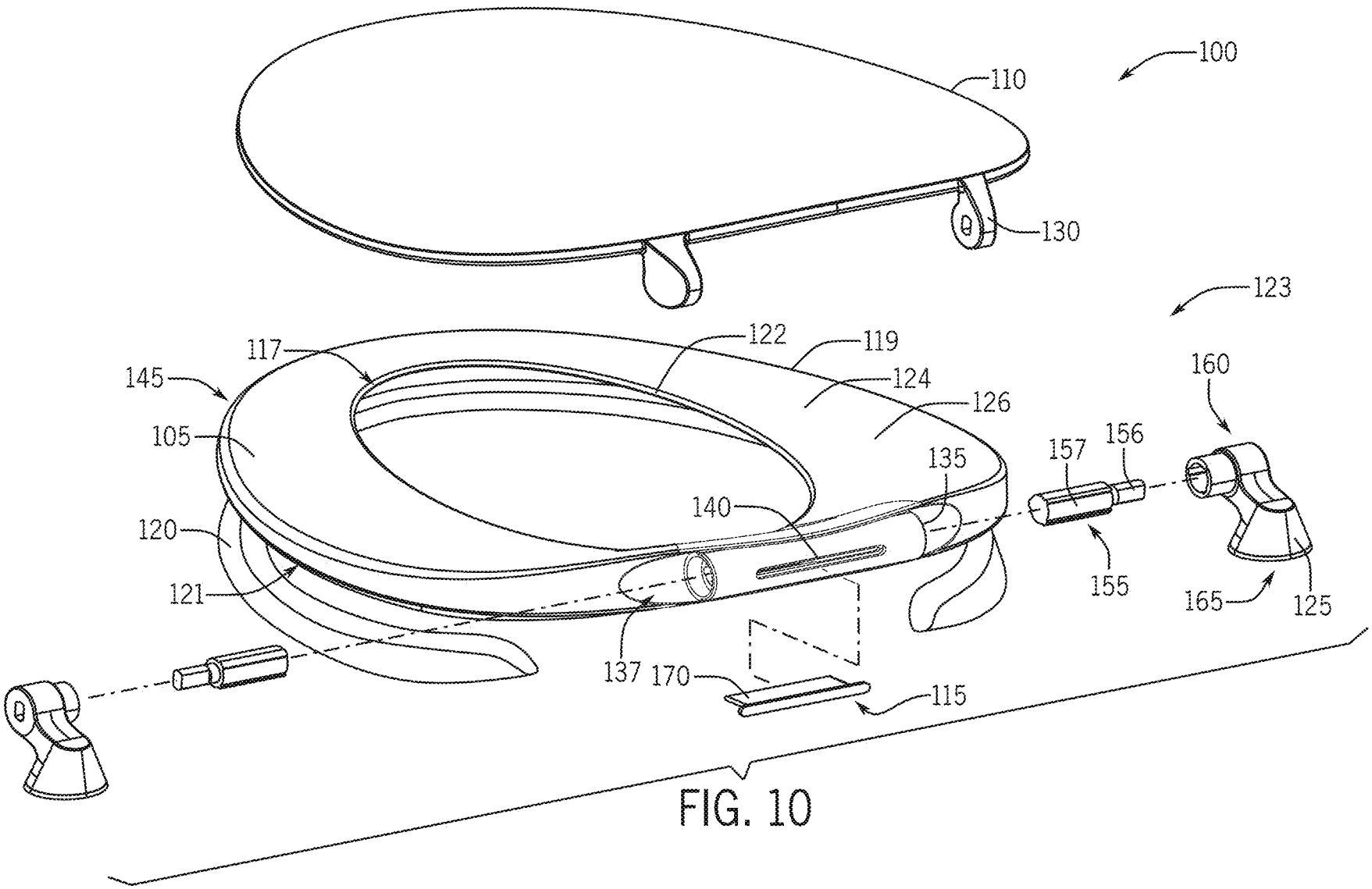
FIG. 10 is an exploded end view of the toilet seat system of FIG. 1, according to an exemplary embodiment.

FIG. 10 shows an exploded view of the toilet seat system 100 near end 123, according to an exemplary embodiment. As shown, the seat 105 includes the inner region 117, which is configured to flex in response to an applied load. An outer region 145 of the toilet seat 105 is configured to be supported by an upper surface of a toilet (e.g., toilet 10). As previously described, seat 105 also includes the hollow channel 135, which is configured to facilitate rotation of seat 105, and the recesses 137 which facilitate unencumbered rotation of the lid 110 (via arms 130) relative to seat 105. The toilet seat system 100 also includes the bumper 120, which is coupled to or interfaces with a bottom surface of the seat 105 and is configured to interface with and grip an upper surface of a toilet (e.g., toilet 10). FIG. 10 shows the bumper 120 as a single, continuous component configured to interface with seat 105 near the outer region 145. In various embodiments, the bumper 120 may include one or more non-contiguous sections. In various embodiments, the bumper 120 may be coupled to or interface with a bottom region of the seat 105 between the inner region 117 and the outer region 145, or the bumper 120 may be coupled to or interface with an entire bottom region of the seat 105.

As shown in FIG. 10, the hinge assembly 115, which enables rotation of the seat 105 and the lid 110, includes the hinges 125, the dampers 155, and a locking tab 170. Each hinge 125 has a first end 160 and a second end 165, wherein the first end 160 has a shoulder that engages with one end of the hollow channel 135, and wherein the second end 165 facilitates coupling of toilet seat system 100 to a surface of the toilet (e.g., the upward facing surface of the rim of toilet 10). Each damper 155 includes a tapered end that is configured to engage with one associated hinge 125. Dampers 155 are configured to control rotation of the seat 105 and/or the lid 110. For example, the dampers 155 may prevent rapid lowering of the seat 105 and resultant impact of seat 105 onto a toilet (i.e., slamming). The dampers 155 each have a ridged body 157, which are disposed within the hollow channel 135. The locking tab 170 is configured to be insertable into hollow channel 135 via the slot 140. The locking tab 170 may engage with each of the dampers 155, such as via each of the corresponding ridged bodies 157.

Figure 11A:
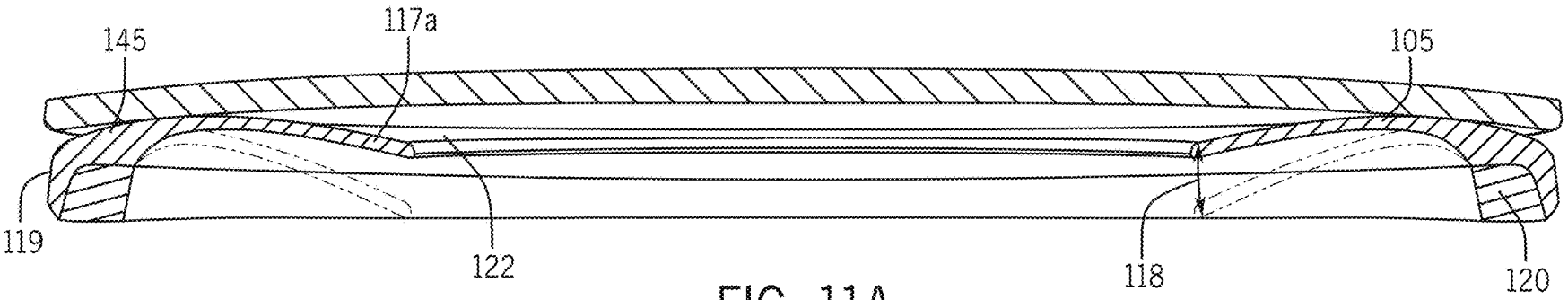
FIG. 11A is a cross-sectional view of the toilet seat system of FIG. 1 taken along line 35-35, according to an exemplary embodiment.
Figure 11B:
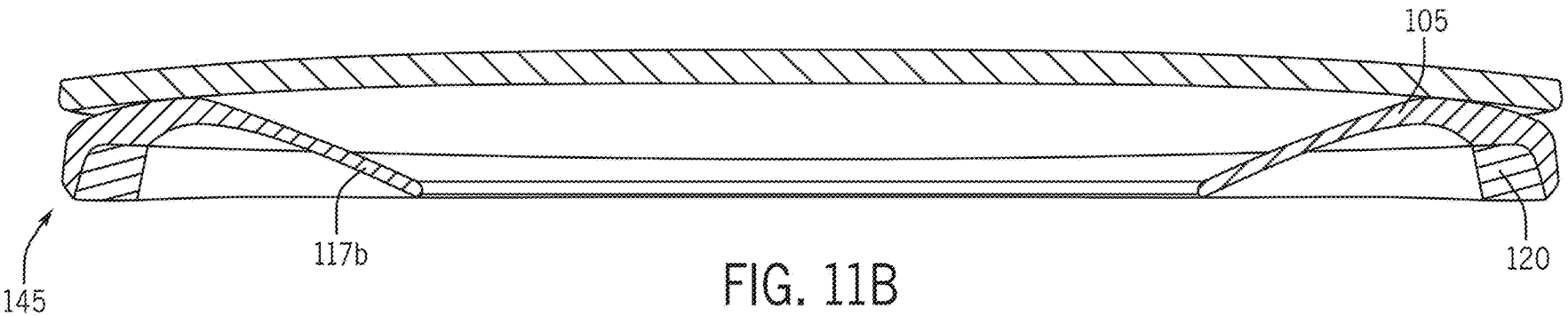
FIG. 11B is a cross sectional view of the toilet seat system of FIG. 1 taken along line 35-35, according to an exemplary embodiment.
Figure 12:
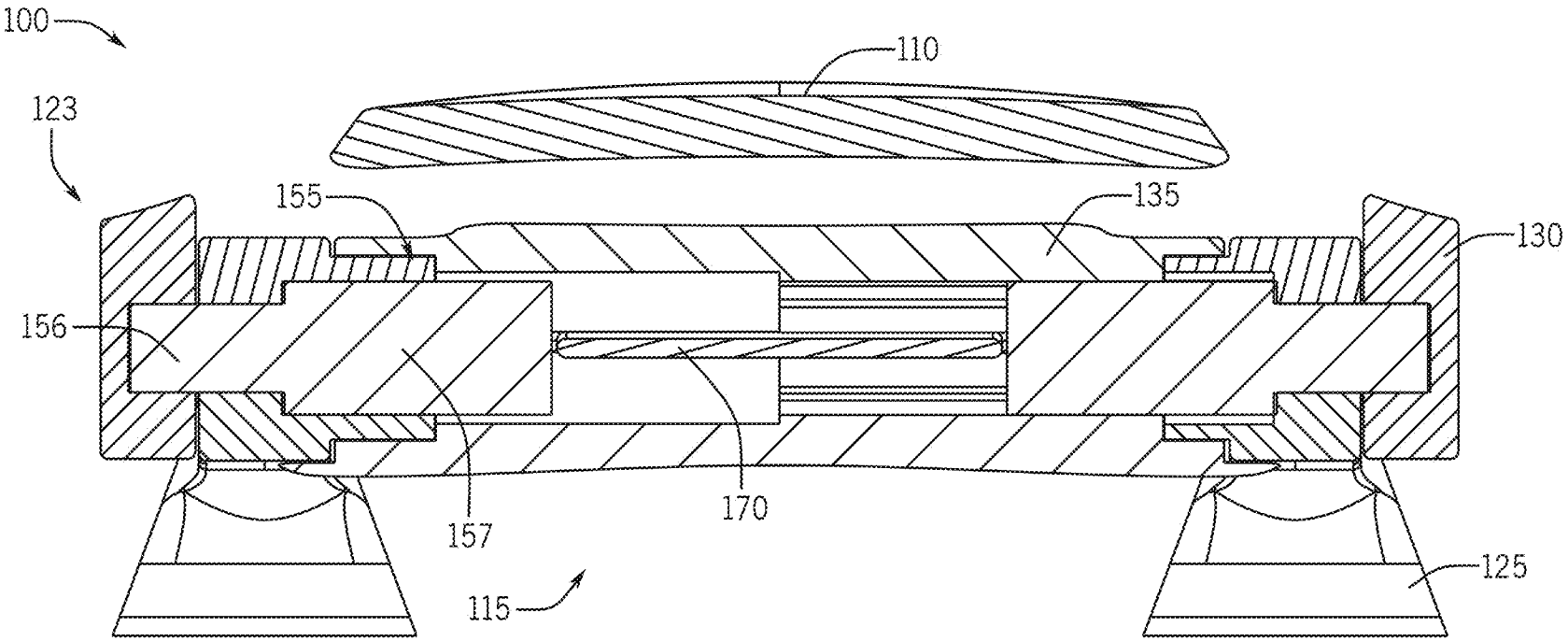
FIG. 12 is an end cross-sectional view of the toilet seat system of FIG. 1 taken along line 40-40, according to an exemplary embodiment.

FIGS. 11A-12 show end cross-sectional views of the toilet seat system 100 taken along line 35-35, according to various exemplary embodiments. FIGS. 11A and 11B illustrate the contoured configuration of the seat 105. As shown, the outer region 145 of the seat 105 may be configured to engage with and/or be supported by the bumper 120 and/or an upper surface of a toilet (e.g., toilet 10). As shown, the outer region 145 of the toilet seat may be configured to support the inner region 117 of the toilet seat. The inner region 117 of the seat 105 may contour inward away from the outer region 145, which enables load responsive deformation.

Deformation of the inner region 117 facilitates improved comfort experienced by the user by relieving pressure applied to their ischial tuberosity. By deforming in response to a user load, the inner region 117 enables accommodation of a spectrum of users, including varying weights and/or dimension thereof. Further, deformation of the inner region 117 is further beneficial as it helps to prevent excessive strain and subsequent mechanical failure of the toilet seat system 100.

As shown, the inner region 117 of the toilet seat 105 may deform in response to an applied load (e.g., when a user sits on the seat 105). As illustrated, the outer region 145 may be configured to support the inner region 117 when a load is applied to the toilet seat 105. The inner region 117 may deform elastically and vertically inward relative to the outer region 145 of the toilet seat 105. In some embodiments, the inner region 117 may deform in response to the magnitude of the applied load. In various embodiments, the inner region 117 may deform in response to the location of the applied load. In some embodiments, the inner region 117 may deform according to a user height, user weight, or a user gender. In various embodiments, the inner region 117 may be configured to facilitate user comfort. In some embodiments, the inner region 117 may be configured to facilitate longevity of the toilet seat system.

FIG. 11A illustrates the toilet seat system 100 in a first state in which there is not an applied load on the toilet seat 105. As shown, the inner region 117 may be located in a first position 117*a* when there is not a load applied to the toilet seat 105. As illustrated, the inner region 117 may deform within the deformation range 118 of the inner region 117 in response to a load being applied to the toilet seat 105. The inner region 117 of the toilet seat 105 may deform to various positions within the deformation range 118.

FIG. 11B shows the toilet seat system 100 of FIG. 11A in a second state in which a load is applied to the toilet seat 105. As shown in FIG. 11B, the inner region 117 of the toilet seat 105 may deform elastically and vertically inward relative to the outer region 145 of the toilet seat in response to an applied load on the toilet seat 105. As shown, the inner region 117 has deformed in response to an applied load and is located at a second position 117*b*.

In some embodiments, the inner region 117 may be configured to deform according to a material comprising the inner region 117. In various embodiments, the inner region 117 is one of substantially flexible material configured to deform in response to an applied load. In some embodiments the inner region 117 is composed of one or more substantially flexible materials. The inner region 117 may comprise a rubber, a viscoelastic polymer, or a composite material. In various embodiments, the inner region 117 may contain woven fibers. The deformation of the inner region 117 may be based on density, pattern, amount, or type of woven fiber included within the region 117.

In some embodiments, the inner region 117 may be configured to deform according to the shape of the toilet seat 105. In various embodiments, the inner region 117 may be configured to deform in response to a thickness of the inner region 117. In some embodiments, deformation of the inner region 117 may be configured to occur according to a varying cross section of the toilet seat 105. In various embodiments, the inner region 117 may deform according to a bending profile of the inner region. In some embodiments, the inner region 11 may deform according to the width of the toilet seat. In various embodiments, deformation of the inner region 117 may be facilitated by and occur according to an inner region 117 having a smaller thickness compared to the outer region 145.

FIG. 3 shows a top view of the toilet seat system 100 attached to the toilet 10 with the lid 110 in a lifted position according to an exemplary embodiment. FIG. 3 illustrates a first position 124 and a second position 126 on the toilet seat 105. As illustrated the width of the toilet seat 105 at the first position 124 is smaller than the width of the toilet seat 105 at the second position 126. The inner region 117 of the toilet seat 105 may be configured to deform in response to the location of the applied load. For example, if a load is applied at the first position 124 the inner region 117 may be configured to deform less than if the load were applied to the second position 126. Configuring the inner region 117 to deform based on the location of the applied load allows the toilet seat 105 to comfortably accommodate users of various sizes, heights, and genders as such users may sit at different locations on the toilet seat 105.

Figure 26:
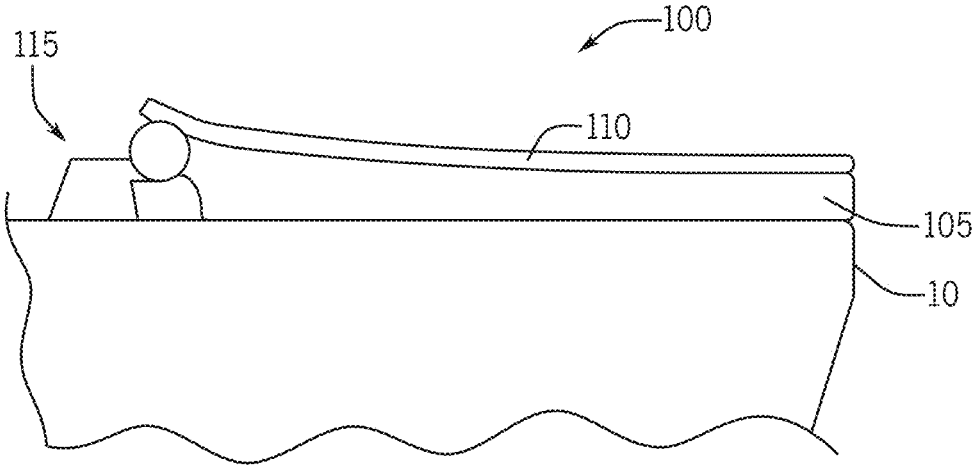
FIG. 26 is a side view of the toilet seat system and toilet of FIG. 1, according to an exemplary embodiment.

FIG. 26 shows a side view of the toilet seat system 100 and toilet 10 according to an exemplary embodiment. FIG. 26 shows the seat 105 and the lid 110, which are rotatably connected to the toilet 10 by the hinge assembly 115. As shown in FIG. 26 when the seat 105 is in a lowered position it is supported by the upper surface 127 of the toilet 10. FIG. 26 illustrates an exemplary embodiment in which the toilet seat 105 contacts the upper surface 127 of the toilet 10 all the way around the toilet seat 105, for example, along the entire circumference of the toilet seat 105. With respect to the toilet seat 105, the circumference may have a horseshoe or arc shape. As described, the toilet seat 105 contacting the upper surface 127 all the way around the toilet seat 105 seals the seat 105 and toilet 10 and prevents toilet plume (e.g., airborne particles dispersed when a toilet is flushed) from being dispersed between the seat 105 and upper surface when the toilet 10 is flushed. In various embodiments a bumper 120 attached to the bottom surface of the base 121 of the toilet seat may contact the upper surface 127 of the toilet 10 all the way around toilet seat 105 preventing the spread of plume. Reducing the spread of toilet plume provides for a more sanitary environment and helps reduce the risk of spread of pathogens.

FIG. 12 shows a cross-sectional view of the toilet seat system 100 along line 40-40. FIG. 12 illustrates the relative configuration of components within the hinge assembly 115. As shown, the hollow channel 135 within the seat 105 houses the dampers 155, which are configured to engage with the hinges 125 and the locking tab 170.

Figure 13:
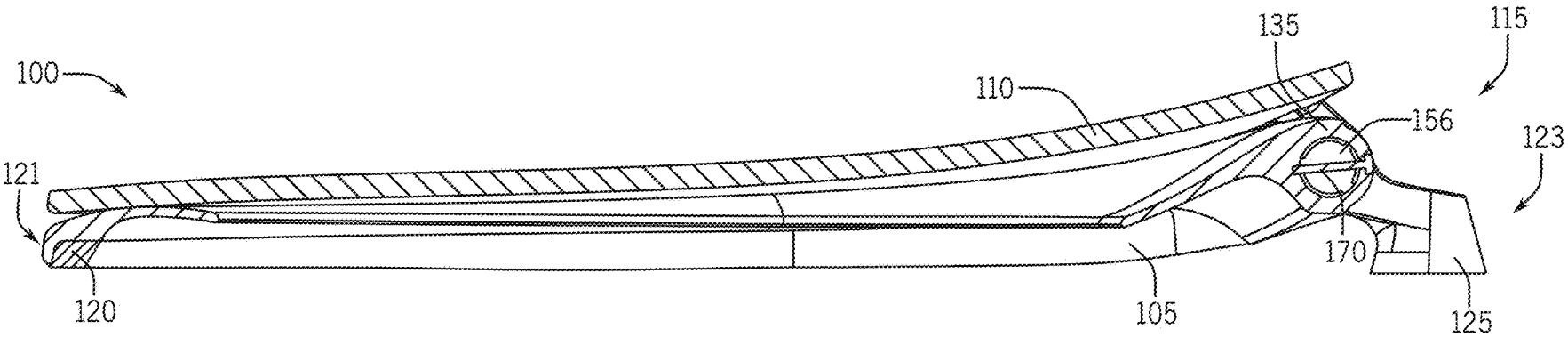
FIG. 13 is a side cross-sectional view of the toilet seat system of FIG. 1 taken along line 20-20, according to an exemplary embodiment.
Figure 14:
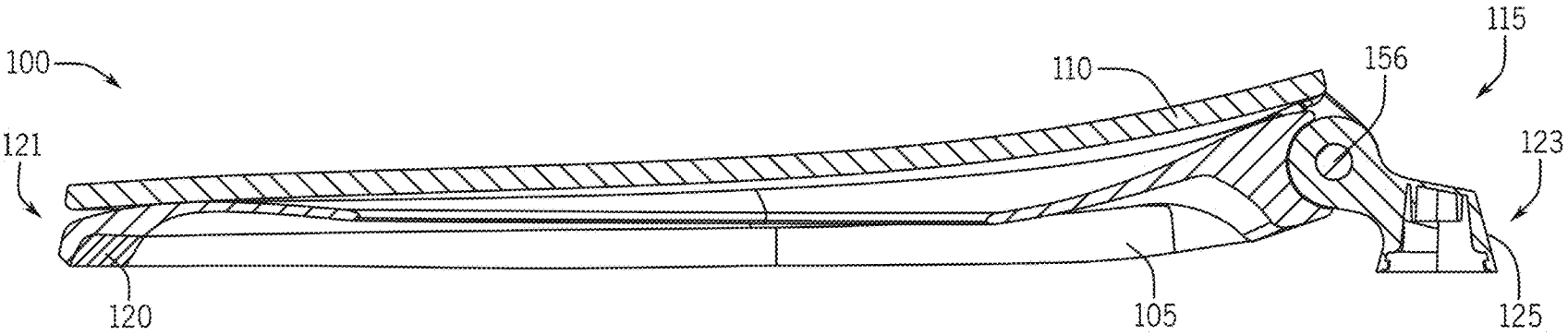
FIG. 14 is a side cross-sectional view of the toilet seat system of FIG. 1 taken along line 25-25, according to an exemplary embodiment.
Figure 15:
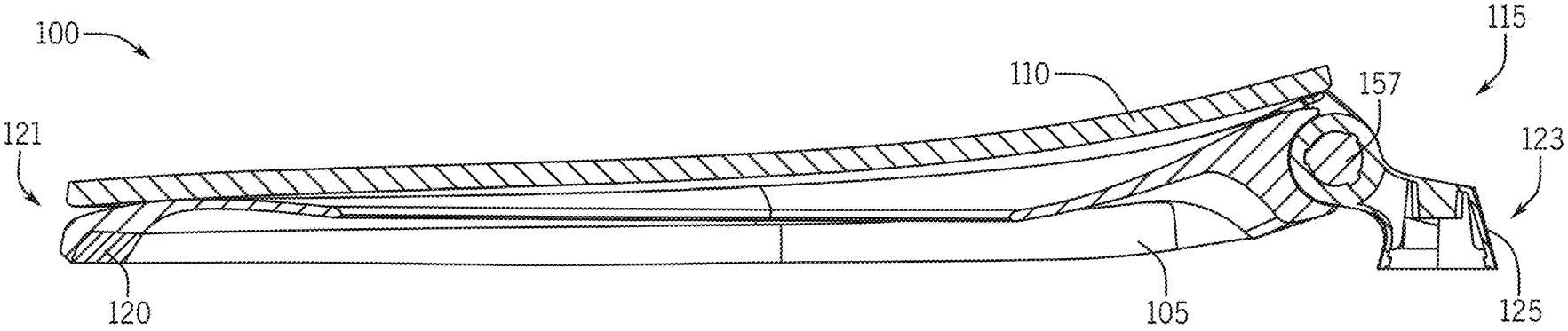
FIG. 15 is a side cross-sectional view of the toilet seat system of FIG. 1 taken along line 30-30, according to an exemplary embodiment.

FIGS. 13-15 show side cross-sectional views of the toilet seat system 100, according to exemplary embodiments. FIG. 13 shows a cross-section of the toilet seat system 100 along line 20-20. FIG. 14 shows a cross-section of the toilet seat system 100 along line 25-25. FIG. 15 shows a cross-section of the toilet seat system 100 along line 30-30. FIGS. 13-15 illustrate how the dampers 155, and specifically the tabs 156 and ridged bodies 157, engage with the locking tab 170 and the hinges 125. As shown, the locking tab 170 engages with a ridge within each of the ridged bodies 157 of the dampers 155 such that the dampers 155 do not rotate as the seat 105 and/or the lid 110 rotate about the hinge assembly 115.

Figure 16:
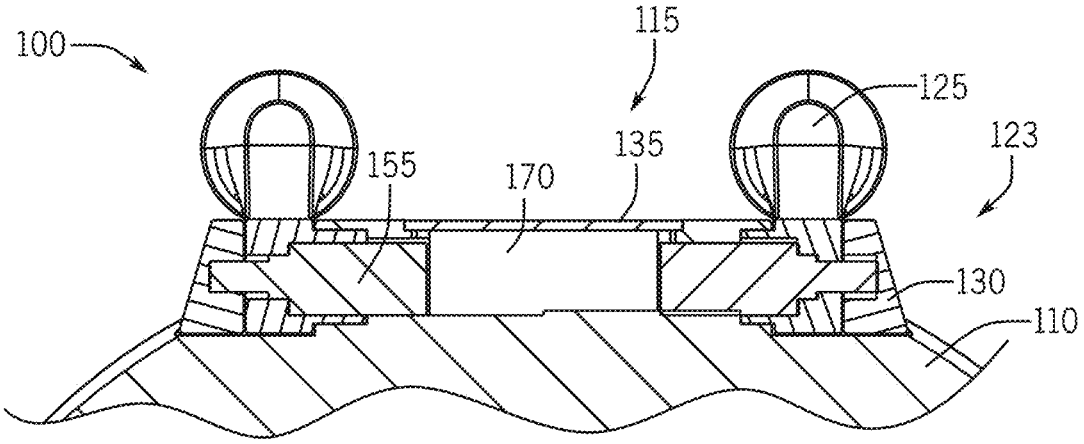
FIG. 16 is a top cross-sectional view of the toilet seat system of FIG. 1 near a hinge assembly taken along line 45-45, according to an exemplary embodiment.
Figure 17:
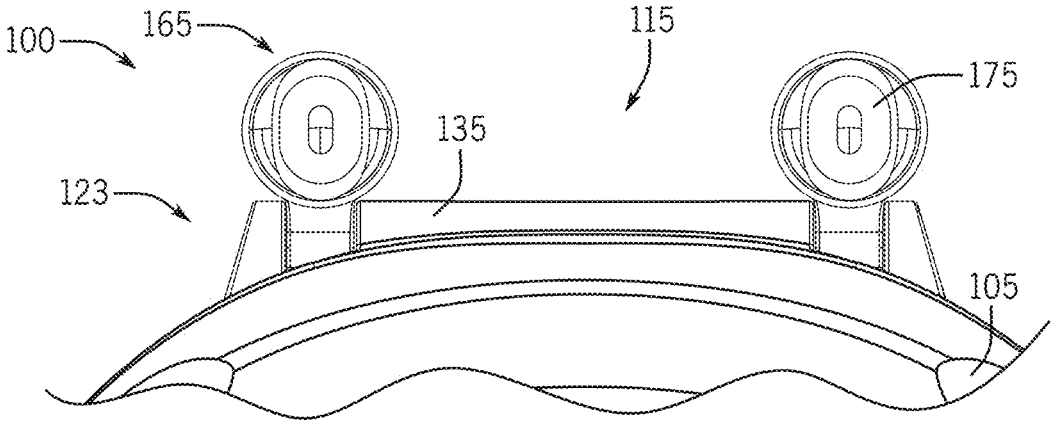
FIG. 17 is a bottom view of the toilet seat system of FIG. 1 near the hinge assembly, according to an exemplary embodiment.

FIGS. 16 and 17 show top and bottom cross-sectional views, respectively, of the toilet seat system 100 near the distal end 123. FIG. 16 shows a cross-sectional view of the toilet seat system 100 in a same spatial plane as the locking tab 170, which illustrates placement of the dampers 155 within the hollow channel 135. FIG. 17 shows a cross-sectional view of the toilet seat system 100 near the second ends 165 of each of the hinges 125. As shown, each of the hinges 125 are configured to engage with and encapsulate therein, a hinge tower 175 to facilitate coupling to a toilet (e.g., toilet 10).

Figure 18:
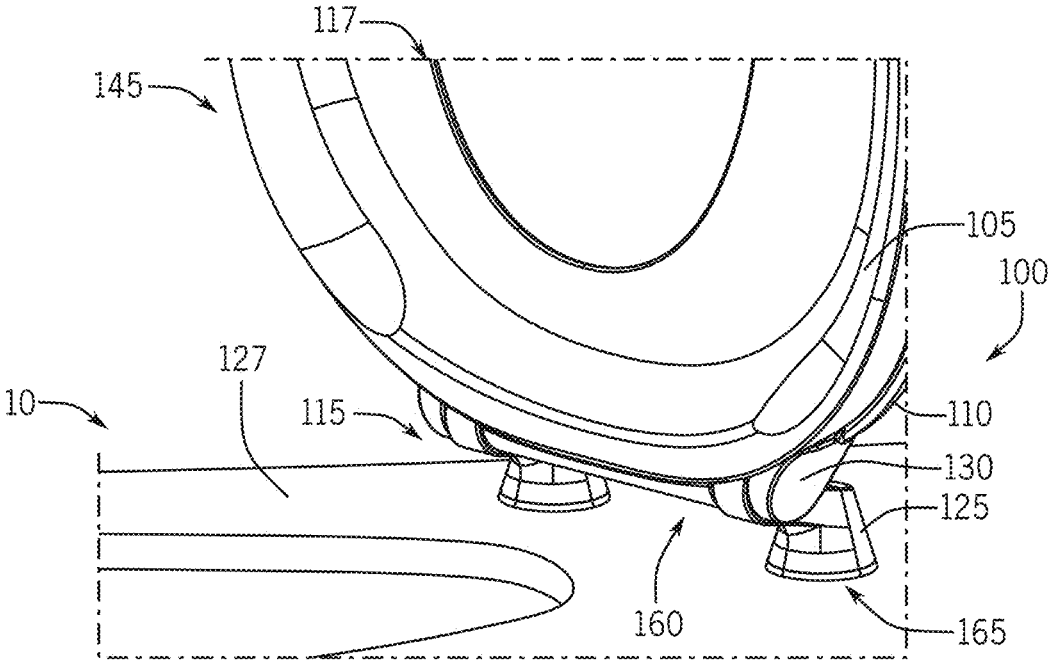
FIG. 18 is a perspective view of the toilet seat system of FIG. 1 near the hinge assembly, according to an exemplary embodiment.
Figure 19:
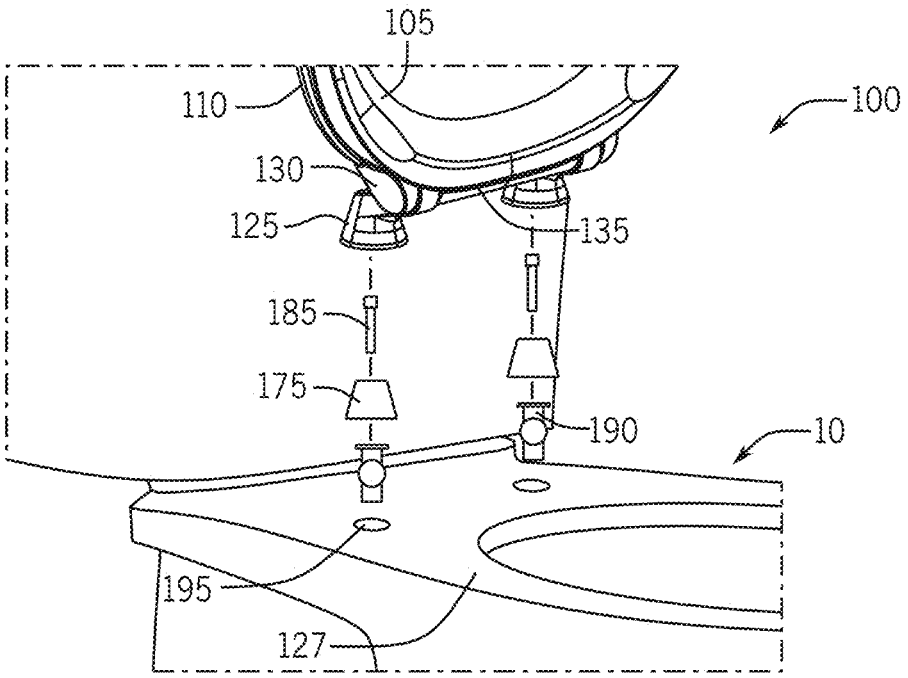
FIG. 19 is a perspective view of the toilet seat system of FIG. 1, showing hinge assembly components, according to an exemplary embodiment.

FIGS. 18 and 19 show side perspective views of the toilet seat system 100, according to various exemplary embodiments. FIG. 18 illustrates relative arrangements of the toilet seat 105, the lid 110, and the hinge assembly 115 while the toilet seat system 100 is in a lifted configuration. As shown, the hinges 125 mount to the pedestal of the toilet to rotatably couple the seat 105 and the lid 110 (within the hinge assembly 115) at the first ends 160 of each hinge 125. Each hinge 125 flexibly couples to a toilet 10 at second ends 165 such that the resultant coupling allows a threshold amount of movement and/or elastic deformation in lateral and/or vertical directions relative to the hinges 125. Flexible coupling of the hinge 125 accommodates movement or deformation of the toilet seat 105. In various embodiments flexible coupling of the hinge 125 allows the hinge assembly 115 to be mounted to uneven mounting surfaces. As illustrated in FIG. 18, the hinge assembly 115 rotatably connects the seat 105 and lid 110 at a rotating axis (rotation axis) located at a height above the upper surface 127 of the toilet 10. Rotatably connecting the seat 105 and the lid 110 at a height above the upper surface 127 facilitates flexible coupling of the hinge 125 and provides for easier cleaning of the toilet 10, seat 105, lid 110, and hinge assembly 115.

FIG. 19 shows components for coupling the toilet seat system 100 to toilet 10. As shown, each hinge 125 couples to an associated hinge tower 175. In various embodiments, the hinge tower 175 may consist of one or more flexible materials. In various embodiments, the one or more flexible materials may include rubbers, polymers, plastics, composites, woven materials, or any other elastic or viscoelastic material known in the art. Each of the hinge towers 175 may be coupled to the toilet 10 via a fastener 185 (e.g., cap screw), which is configured to engage with a flexible anchor 190. Each anchor 190 fits within an associated hole 195 in the toilet 10 (e.g., in the vitreous base/pedestal) and is configured to anchor the hinge tower 175 (and, if coupled, the hinge 125) to toilet 10. In various embodiments, the anchor 190 may consist of one or more materials that are the same as or different from the hinge tower 175. In various embodiments, anchor 190 may consist of one or more elastic or viscoelastic materials known in the art. Anchor 190 is further configured to fit inside and engage with the hinge tower 175. As described, the hinge tower 175 and the anchor 190 may each consist of one or more elastic and/or viscoelastic materials to facilitate flexible coupling of the toilet seat system 100 to the toilet 10 and prevent damage or failure under applied loads and/or disadvantageous movements during use (e.g., if a user rapidly sits, slides, and/or shifts).

Figure 20:
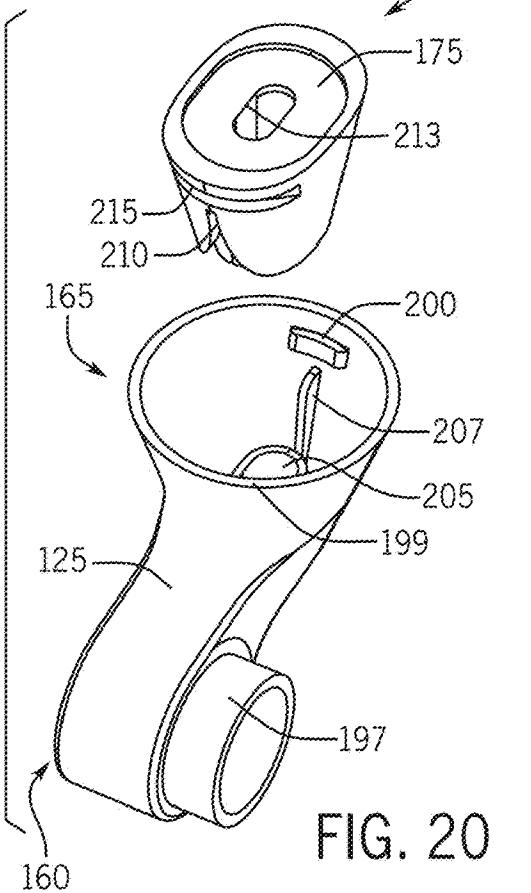
FIG. 20 is a bottom perspective view of a hinge stack within the toilet seat system of FIG. 1, according to an exemplary embodiment.

FIG. 20 shows a bottom perspective view of a hinge stack assembly 196, according to an exemplary embodiment. The hinge stack assembly 196 includes a hinge 125, hinge tower 175, fastener 185, and anchor 190. As shown, the hinge 125 includes an extruded portion 197 near the first end 160, which engages with the dampers 155 and the hollow channel 135 within the hinge assembly 115. The second end 165 of the hinge 125 is configured to form an opening defined by an outer edge 199 and leading to a bore, which contains at least one coupling feature or mechanism therein to facilitate coupling (e.g., engagement, securing) of the hinge 125 with the hinge tower 175. Coupling features within the second end 165 of the hinge 125 include a socket 205, one or more ridges 207 extending inwardly from a wall of the hinge 125, and one or more tabs 200 extending inwardly from the wall at different locations than the ridges. Each ridge 207 and tab 200 is configured to engage with an associated groove 210 and an associated slot 215, respectively, of the hinge tower 175. As shown, the hinge tower 175 also includes a central hole 213, which is configured to receive and engage with the anchor 190. In various embodiments, the central hole 213 is also configured to receive a fastener (e.g., a bolt, fastener 185, etc.) to couple the hinge tower 175 securely to a toilet (e.g., toilet 10). The central hole 213 may be configured to engage with features within the hinge 125.

Figure 22:
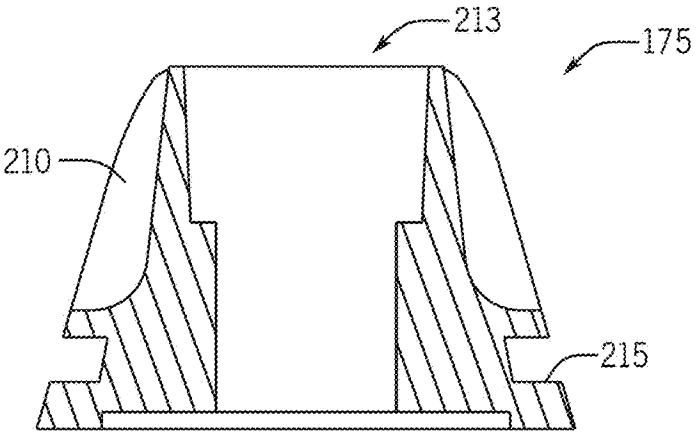
FIG. 22 is a side cross-sectional view of a hinge tower within the toilet seat system of FIG. 1 taken along line 30-30, according to an exemplary embodiment.
Figure 21:
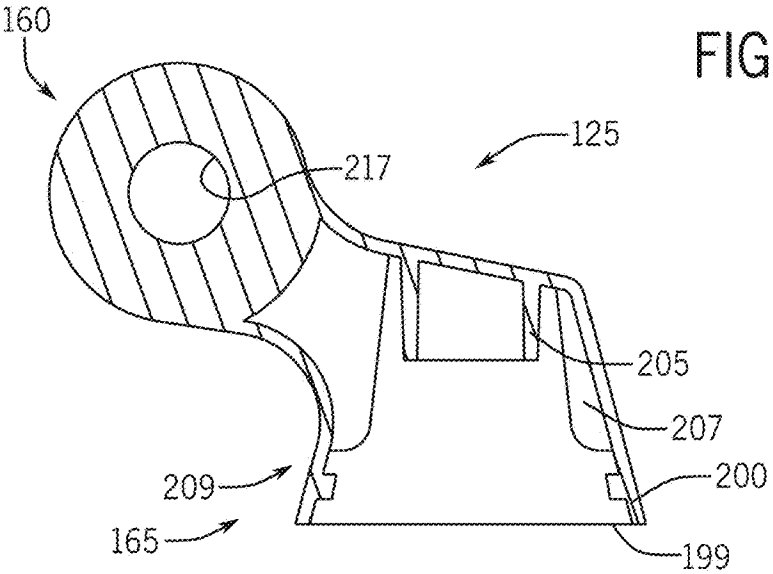
FIG. 21 is a side cross-sectional view of a quick-connect hinge within the toilet seat system of FIG. 1 taken along line 30-30, according to an exemplary embodiment.

FIGS. 21 and 22 show side cross-sectional views taken along line 30-30 of the hinge 125 and the hinge tower 175, respectively. As shown in FIG. 21, the hinge 125 includes a central recess 217 within the first end 160, which defines a pivot axis (of the hinge 125) and is configured to receive and engage with the arms 130 of the lid 110. As previously described, the second end 165 includes one or more tabs 200 and/or one or more ridges 207 disposed therein, which are configured to engage with one or more grooves 210 and slots 215, respectively, within the hinge tower 175. The second end 165 of the hinge 125 contains a socket 205, which is configured to engage with the hinge tower 175. The socket 205 is defined by an inner wall extending within the outer wall (defined by outer edge 199), wherein the inner wall extends generally in a longitudinal direction. Furthermore, the hinge 125 also includes an uppercut 209 near the second end 165, which is located between the ridges 207 and the tabs 200 and is configured to further enable coupling of the hinge 125 to the hinge tower 175. As shown in FIG. 22, the hinge tower 175 includes one or more grooves 210 and slots 215, which are configured to engage with ridges 207 and tabs 200, respectively. As shown, grooves 210 extend in a longitudinal direction along each of the hinge towers 175 whereas slots 215 are positioned circumferentially around the hinge towers 175. In various embodiments, slots 215 may be a continuous circumferential slot within hinge tower 175. In various embodiments, slots 215 may include one or more discrete slots arranged circumferentially around hinge tower 175. In various embodiments, grooves 210 may be v-shaped, such that an opening of the groove is substantially wider than an end of the groove. In other embodiments, grooves 210 may have a constant width. In other embodiments, hinge tower 175 may include one or more grooves 210, wherein each of grooves 210 has a constant width, has a varying width, or a combination thereof. In various embodiments, each of grooves 210 may have a same or different length. As shown, hinge tower 175 includes a central hole 220, which is configured to engage with socket 205 within hinge 125. When hinge tower 175 and hinge 125 are fully engaged, hinge tower 175 fits within second end 165 of hinge 125.

Figure 23:
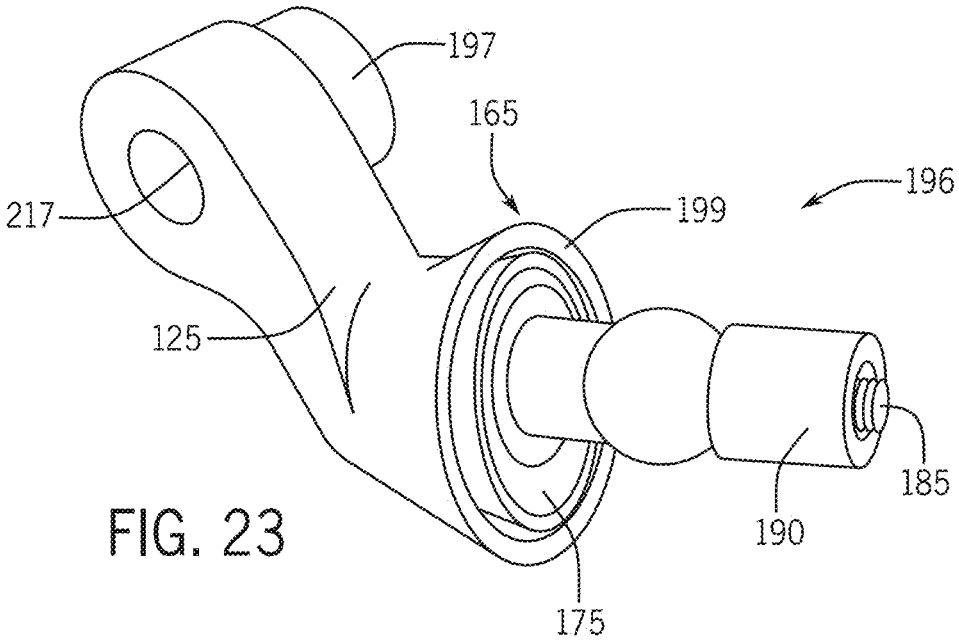
FIG. 23 is a perspective side view of a hinge stack within the toilet seat system of FIG. 1, according to an exemplary embodiment.
Figure 24:
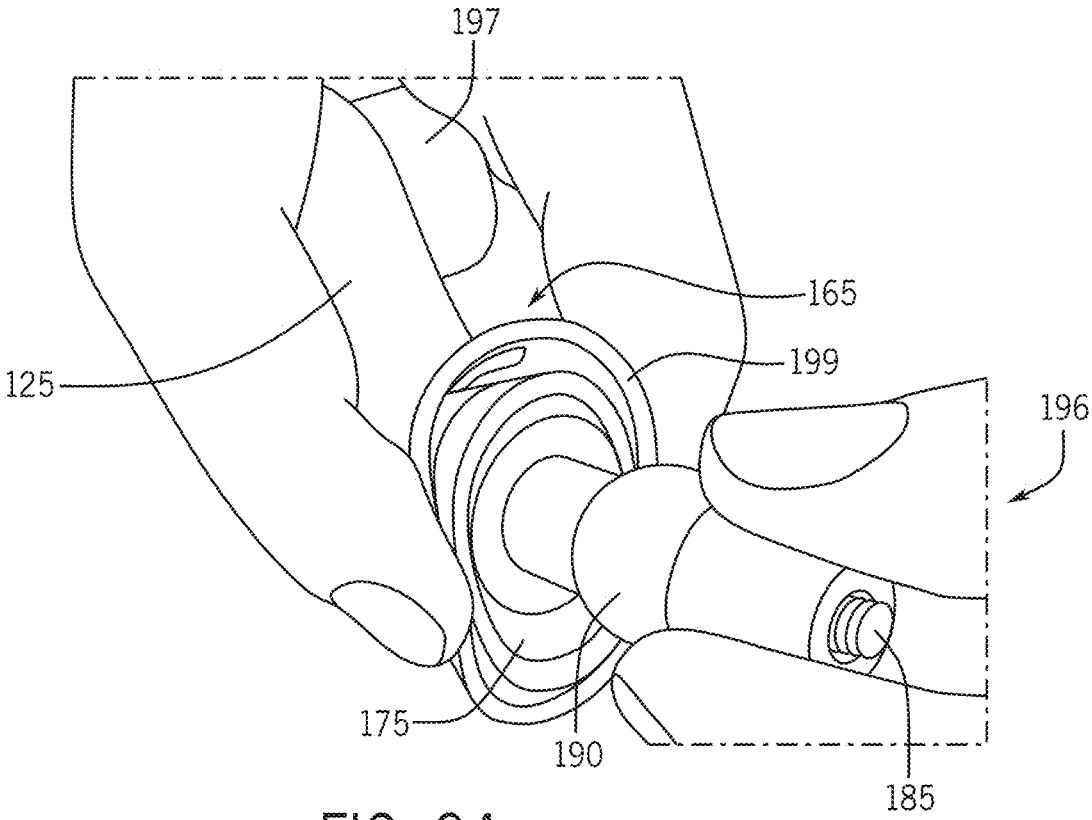
FIG. 24 is a perspective end view of the hinge stack of FIG. 23, according to an exemplary embodiment.
Figure 25:
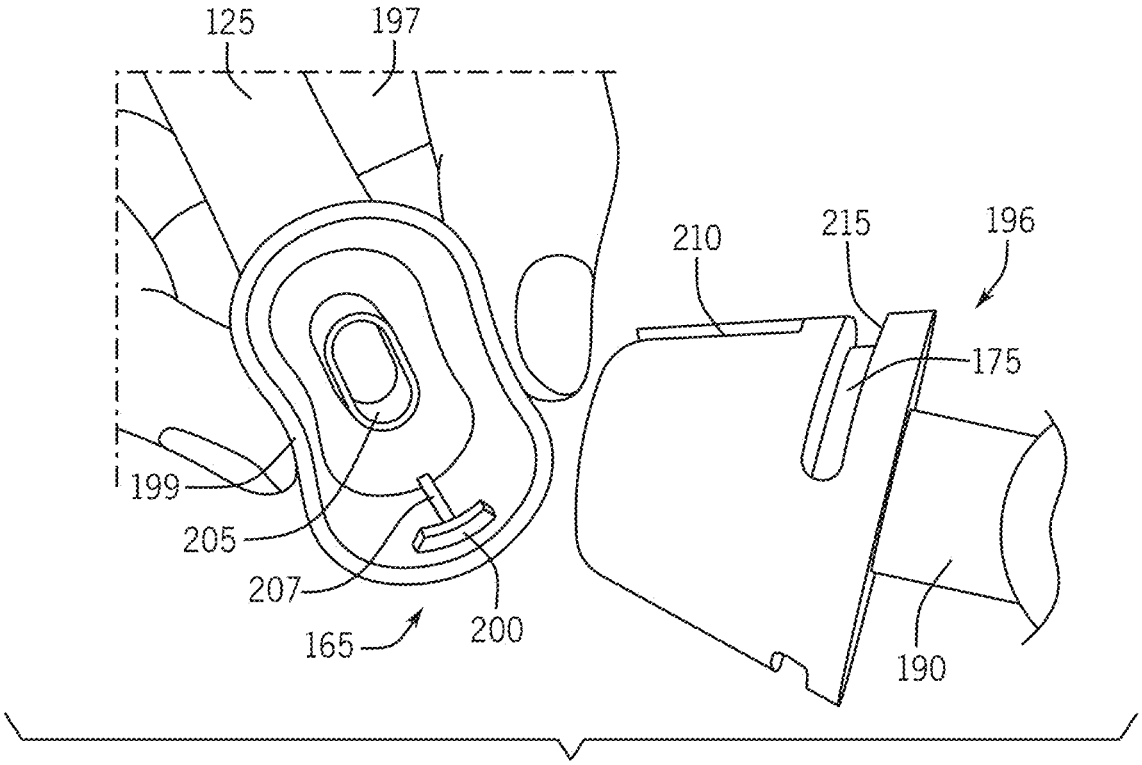
FIG. 25 is a perspective end view of the hinge stack of FIG. 23, according to an exemplary embodiment.

FIGS. 23-25 show alternate perspective views of a hinge stack assembly 196, according to various exemplary embodiments. FIG. 23 shows the hinge stack assembly 196 fully assembled, in a configuration representative of when the hinge stack assembly 196 is coupled to a toilet (e.g., toilet 10), without the toilet being shown for clarity. As shown in FIG. 24, application of a threshold force to the outer edge 199 of the hinge 125 causes a threshold deformation (e.g., elastic deformation) of the second end 165 of the hinge 125. The threshold deformation of the second end 165 causes disengagement of the hinge 125 from the hinge tower 175 by causing disengagement of each of the ridges 207 and the tabs 200 from the grooves 210 and the slots 215, respectively. Once the hinge assembly 125 is disengaged from the hinge tower 175, the components may be separated as shown in FIG. 25. Accordingly, during operation and/or disassembly, the toilet seat system 100 may be uncoupled from a toilet (e.g., toilet 10) by disengaging each hinge 125 from the associated hinge tower 175 by simply applying the threshold force (e.g., intentionally during disassembly or unintentionally from movement during operation or use by a user) to the outer edge 199 on each of the hinges 125. To re-couple the toilet seat system to a toilet (e.g., toilet 10), the hinges 125 may be pressed over the corresponding hinge towers 175 until each of the ridges 207 and the tabs 200 reengage with each of the grooves 210 and the slots 215, respectively. Due to the constituting material and shape of each of the grooves 210 and the slots 215, re-coupling of the toilet seat system 100 may be completed with few or no tools, minimal fasteners, and allowing for a margin of error in placement of the hinges 125 upon the hinge towers 175. Furthermore, since the hinges 125 completely encase each of the hinge towers 175 when the toilet seat system 100 couples to a toilet (e.g., toilet 10), there are few exposed joints or discrete surfaces, which consequently increases cleanability and accessibility of toilet seat system 100. In various embodiments, the outer edge 199 of the hinge 125 may be co-molded with a soft-sealing material to enable sealing the hinge 125 to the toilet (e.g., toilet 10). In various embodiments, the outer edge 199 may be configured to have geometry that facilitates sealing the hinge 125 to the toilet (e.g., toilet 10).

Notwithstanding the embodiments described above in FIGS. 1-26, various modifications and inclusions to those embodiments are contemplated and considered within the scope of the present disclosure.

It is also to be understood that the construction and arrangement of the elements of the systems and methods as shown in the representative embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed.

Accordingly, all such modifications are intended to be included within the scope of the present disclosure. Any means-plus-function clause is intended to cover the structures described herein as performing the recited function and not only structural equivalents but also equivalent structures. Other substitutions, modifications, changes, and omissions may be made in the design, operating conditions, and arrangement of the preferred and other illustrative embodiments without departing from scope of the present disclosure or from the scope of the appended claims.

Furthermore, functions and procedures described above may be performed by specialized equipment designed to perform the particular functions and procedures. The functions may also be performed by general-use equipment that executes commands related to the functions and procedures, or each function and procedure may be performed by a different piece of equipment with one piece of equipment serving as control or with a separate control device.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances, where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

Moreover, although the figures show a specific order of method operations, the order of the operations may differ from what is depicted. Also, two or more operations may be performed concurrently or with partial concurrence. Such variation will depend on hardware systems chosen and on designer choice. All such variations are within the scope of the disclosure.

We claim:

1. A toilet seat assembly comprising:
a toilet seat;
a plurality of hinges;
a hollow channel at a distal end of the toilet seat, the hollow channel configured to couple with the plurality of hinges at opposing recesses of the hollow channel;
a slot on the hollow channel between the opposing recesses; and
a locking component configured to be inserted into the slot of the hollow channel to contact a ridge body of at least one damper.

2. The toilet seat assembly of claim 1, further comprising:
at least one damper, wherein the locking component is configured to engage with the at least one damper so that the at least one damper is independent from a rotation of the toilet seat.

3. The toilet seat assembly of claim 1, further comprising:
at least one protruding arm of a lid configured to couple with the plurality of hinges.

4. The toilet seat assembly of claim 1, further comprising:
a hinge tower configured to facilitate coupling with one hinge of the plurality of hinges.

5. The toilet seat assembly of claim 4, wherein application of a threshold force causes hinge tower to disengage allowing the hinge and hinge tower to be separated.

6. The toilet seat assembly of claim 4, wherein the hinge tower is made of flexible material.

7. The toilet seat assembly of claim 4, further comprising:
a flexible anchor configured to connect with the hinge tower.

8. The toilet seat assembly of claim 7, further comprising:
a fastener securing the flexible anchor to the hinge tower.

9. The toilet seat assembly of claim 7, wherein the flexible anchor is made of flexible material.

10. The toilet seat assembly of claim 1, further comprising:

a bumper located on a bottom surface of the toilet seat.

11. The toilet seat assembly of claim 1, wherein the toilet seat is rotatably connected to the hinge around a rotation axis located at a height above a surface of the toilet allowing for deformation of the plurality of hinges when a load is applied to the toilet seat.

12. A toilet comprising:

a bowl;

a toilet seat;

a plurality of hinges to rotate the toilet seat with respect to the bowl;

a hollow channel at a distal end of the toilet seat, the hollow channel configured to couple with the plurality of hinges at opposing recesses of the hollow channel;

a slot on the hollow channel between the opposing recesses; and a locking component configured to be inserted into the slot of the hollow channel to contact a ridge body of at least one damper.

13. The toilet of claim 12, further comprising:

at least one damper, wherein the locking component is configured to engage with the at least one damper so that the at least one damper is independent from a rotation of the toilet seat.

14. The toilet of claim 12, further comprising:

at least one protruding arm of a lid configured to couple with the plurality of hinges.

15. The toilet of claim 14, further comprising:

a plurality of hinge towers configured to facilitate coupling with the plurality of hinges.

16. The toilet of claim 15, wherein the plurality of hinge towers is made of flexible material.

17. The toilet of claim 15, further comprising:

a flexible anchor configured to connect with the plurality of hinge towers.

18. The toilet of claim 17, further comprising:

a fastener securing the flexible anchor to the hinge tower.

19. The toilet of claim 12, wherein the toilet seat is rotatably connected around a rotation axis located at a height above a surface of the toilet allowing for deformation of the plurality of hinges when a load is applied to the toilet seat.

20. The toilet of claim 12, further comprising:

a hinge tower configured to facilitate coupling with one of the plurality of hinges.

21. A toilet seat assembly comprising:

a toilet seat;

a plurality of hinges;

a hollow channel at a distal end of the toilet seat, the hollow channel configured to couple with the plurality of hinges; and a locking component configured to be inserted into the hollow channel, wherein the toilet seat is rotatably connected to the hinge around a rotation axis located at a height above a surface of the toilet allowing for deformation of the plurality of hinges when a load is applied to the toilet seat.

* * * * *